US008109028B2

(12) United States Patent
Roberts et al.

(10) Patent No.: US 8,109,028 B2
(45) Date of Patent: Feb. 7, 2012

(54) GUN MOUNT

(76) Inventors: Kent S. Roberts, American Fork, UT (US); Brent Roberts, American Fork, UT (US)

( * ) Notice: Subject to any disclaimer, the term of this patent is extended or adjusted under 35 U.S.C. 154(b) by 178 days.

(21) Appl. No.: 12/658,369

(22) Filed: Feb. 12, 2010

(65) Prior Publication Data

US 2011/0197748 A1 Aug. 18, 2011

(51) Int. Cl.
*F41A 29/00* (2006.01)

(52) U.S. Cl. ..... 42/94; 89/37.04

(58) Field of Classification Search ..... 42/94; 89/37.04; 248/425, 415, 419, 183.1
See application file for complete search history.

(56) References Cited

U.S. PATENT DOCUMENTS

| | | | | |
|---|---|---|---|---|
| 7,770,319 | B2 * | 8/2010 | McDonald | 42/94 |
| 8,011,129 | B2 * | 9/2011 | Cauley et al. | 42/94 |
| 2004/0237372 | A1 * | 12/2004 | Frye | 42/94 |
| 2009/0113779 | A1 * | 5/2009 | Shipman et al. | 42/94 |
| 2010/0236125 | A1 * | 9/2010 | Morrow et al. | 42/94 |

* cited by examiner

*Primary Examiner* — J. Woodrow Eldred

(57) ABSTRACT

A gun mount for use in sighting-in long guns having or not having a large bottom feed, clip magazine, belt, drum or other bottom loaded ammunition feed system includes a base to be mounted on a table top or other suitable surface and that supports a rotatably mounted gun holder on which a long gun is placed. The gun holder allows the gun barrel to be adjustably fixed in each of a horizontal and vertical position. An aligned sight picture is set into the gun sights and is maintained or reset after the gun is fired by shock absorbers that keep recoil shock from changing the sight settings, or return the gun to the position at which the sights have been set.

13 Claims, 8 Drawing Sheets

GUN MOUNT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

This invention relates to gun sighting mounts and is concerned with gun mounts used in the sighting of long barrel guns having a magazine or other under gun ammunition feed system.

The invention is more particularly concerned with the sighting-in of high powered and/or semi-automatic and/or automatic long barrel weapons.

Many different types of gun mounts have been used, in the past, to aim and sight-in long guns. Recently, however, there have been many more gun owners desiring to sight-in high powered, automatic weapons.

Because high powered, extremely fast firing long guns discharge rounds at a very rapid rate, the weapons often have large bullet holding magazines, clips or belts that project beneath the weapon during use. It is therefore necessary that any gun mount used in sighting-in such weapons provide clearance beneath the supported weapon for such bullet holding and feed structures. At the same time, because of the explosive power of the bullets fired through the weapons, it is highly desirable that the weapon be mounted on structure that will absorb much of the shock resulting from the rapidly fired rounds used in aiming and sighting-in the weapon.

Additionally, many features found on known gun sighting mounts still need to be incorporated into a gun mount that will accommodate sighting of long guns having a bullet feed mechanism extending beneath the gun.

Consequently, a gun mount used for sighting long guns with bullet holding magazines, or the like, must also provide for vertical and horizontal adjustments to allow accurate sighting and locking in of a sight picture. It is also desirable to minimize recoil shock, and particularly recoil shock that may change the sight picture between successive shots.

Even though many gun mount devices have been proposed in the past for securing long guns during aiming and sighting-in, there remains a need for such a mount that will hold rapid firing, high powered long guns in a secured set position, during aiming and sighting-in.

BRIEF SUMMARY OF THE INVENTION

Objects of the Invention

Principal objects of the present invention are to provide a gun mount that can be conveniently positioned on a shooting table top or other suitable surface and that will receive and hold long guns during the aiming and sighting-in of such weapons.

Other objects of the invention are to provide a gun mount having ample clearance for a bottom loading magazine or other bullet holding and feed mechanism inserted into and projecting from the underside of a gun being aimed or sighted-in.

Another object of the invention is to provide a gun mount that is stable during aiming and sighting-in procedures and that will at least partially absorb and minimize the recoil shock occurring as rounds are fired and discharged from the muzzle of the weapon.

Still another object of the invention is to provide a weighted mount for aiming and sighting-in of rapid firing, high caliber long guns that can be easily setup, on a table, for example, to permit a user to raise, lower and horizontally rotate the barrel of a gun while aiming and sighting-in the weapon during single shot firing, semi-automatic firing, and fully automatic firing.

Yet another object is to provide a gun mount that will permit rotation of the gun being sighted in a horizontal plane as well as vertical pivoting of the gun muzzle when setting up a sight picture. The gun is locked in place to maintain the sight picture and shock absorbers are provided to prevent or reduce the possibility of the sight picture at any selected range will be lost due to recoil action of the weapon.

Features of the Invention

Principal features of the invention include a gun mount having a base with legs that are adjustable to permit leveling of the base. The base also has trays that can be readily filled with bags of sand, or other weights to further stabilize the base during use of the gun mount.

The gun mount further include a gun holder rotatably mounted on the base to permit horizontal alignment of a long gun positioned on the gun holder and a vertical adjustor to adjust and secure the gun sights for vertical position on a target.

The gun holder positions the gun to have clearance beneath the gun to accommodate a bottom ammunition feed system of the gun.

Shock absorbers acting between the base and the gun holder at least partially absorb recoil to minimize repositioning of the gun being sighted, and particularly to absorb torque forces that might otherwise occur if the gun being sighted-in is offset with respect to the pivot axis through a base bottom plate and an overlying central plate of the gun holder.

Additional objects and features of the invention will become apparent from the following drawings and detailed description.

BRIEF DESCRIPTION OF THE FIGURES OF THE INVENTION

In the Drawings

Figure 1:
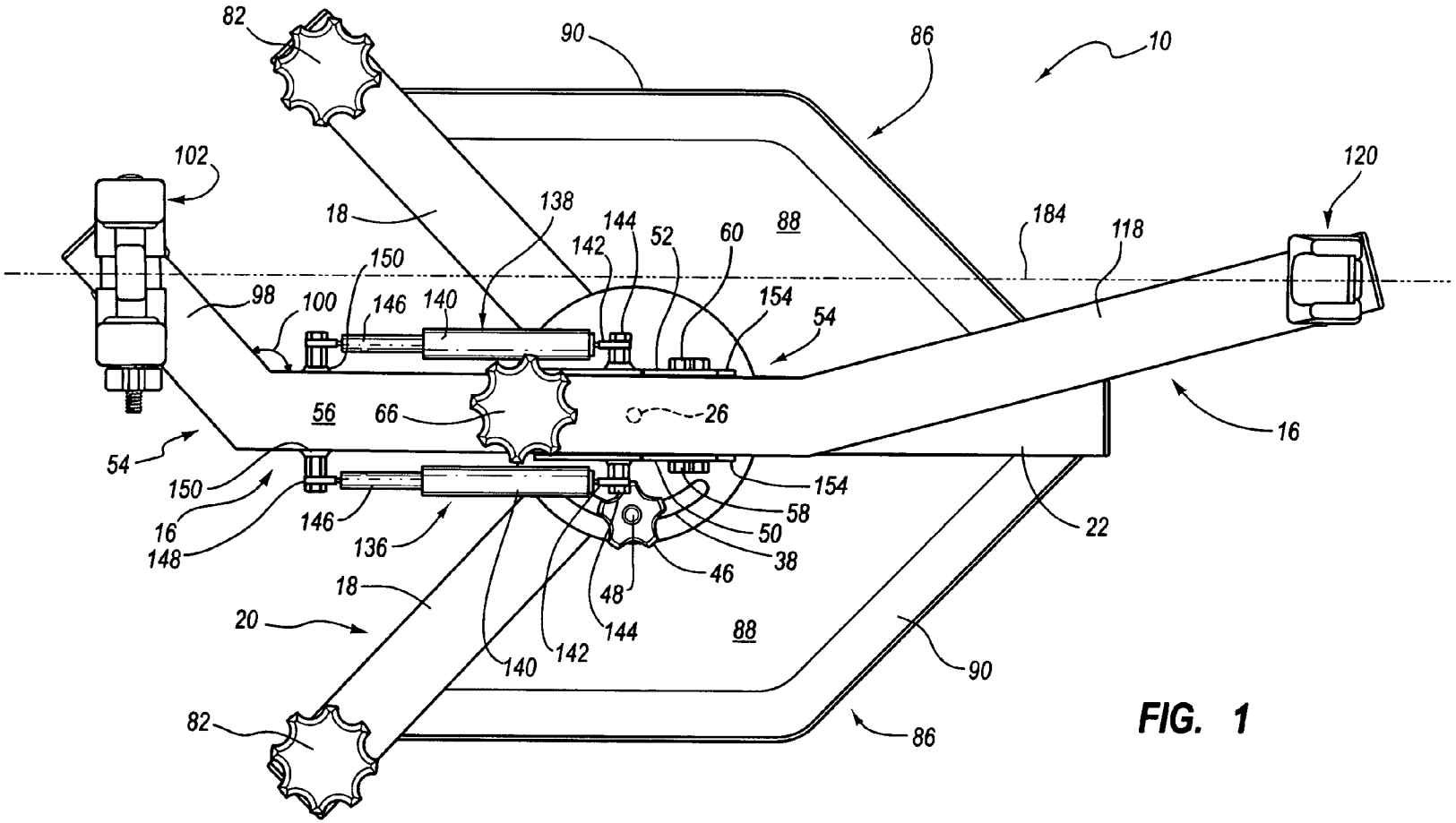
FIG. 1 is a top plan view of a gun mount of the invention.
Figure 2:
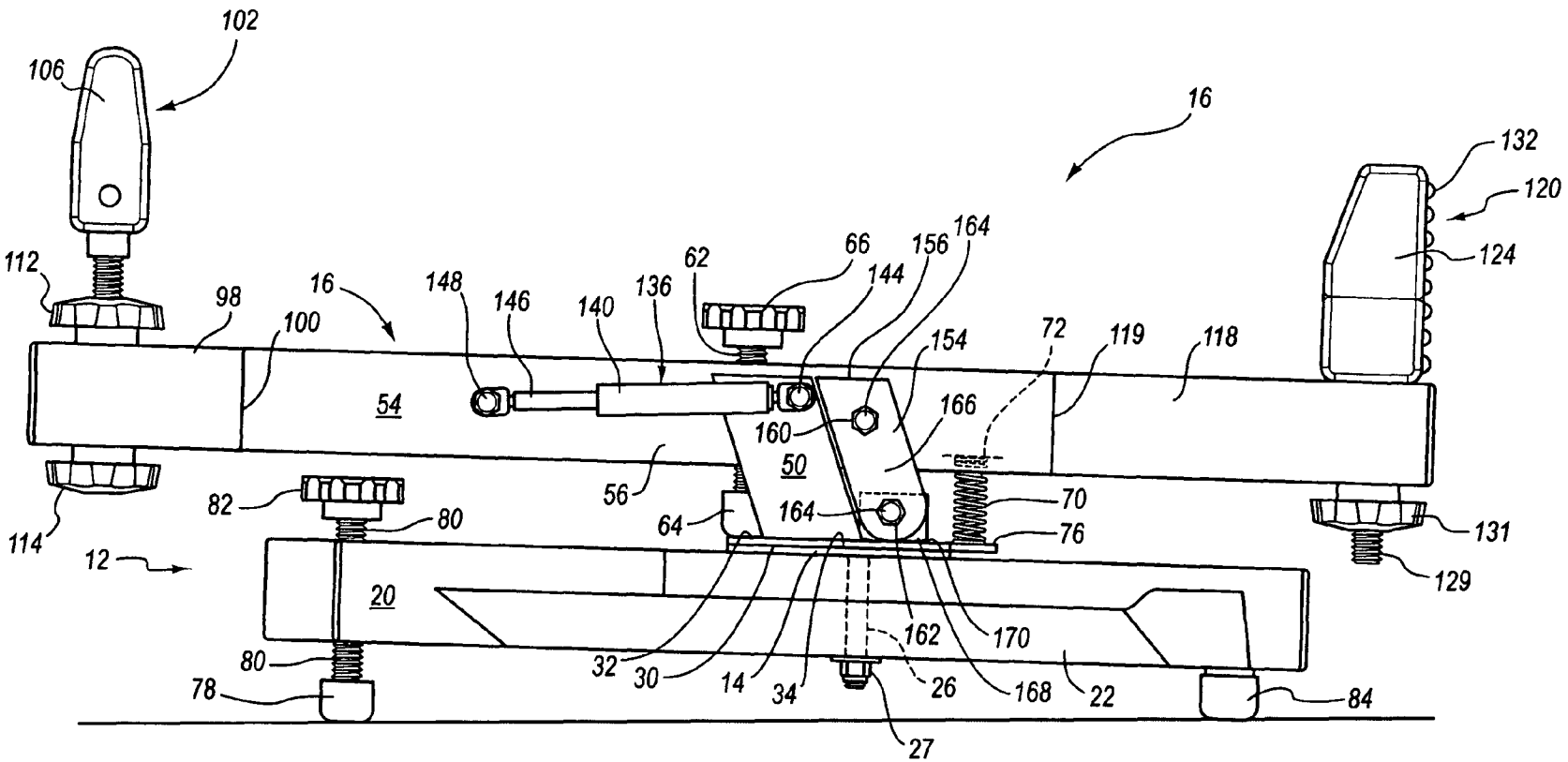
FIG. 2 is a side elevation.
Figure 3:
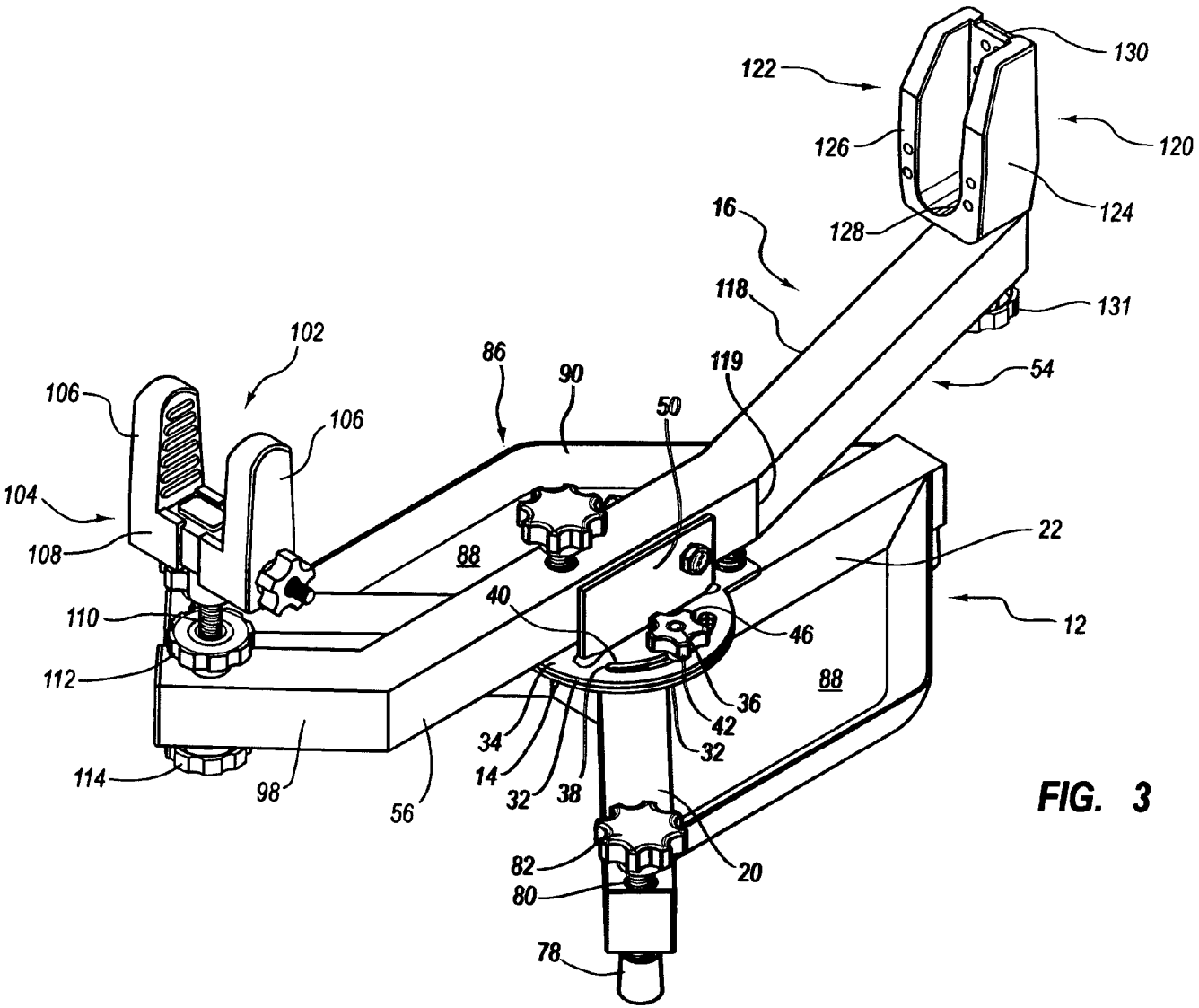
FIG. 3 is a perspective view taken from a front upper corner, of the invention, and showing the gun mount without shock absorbers.
Figure 4:
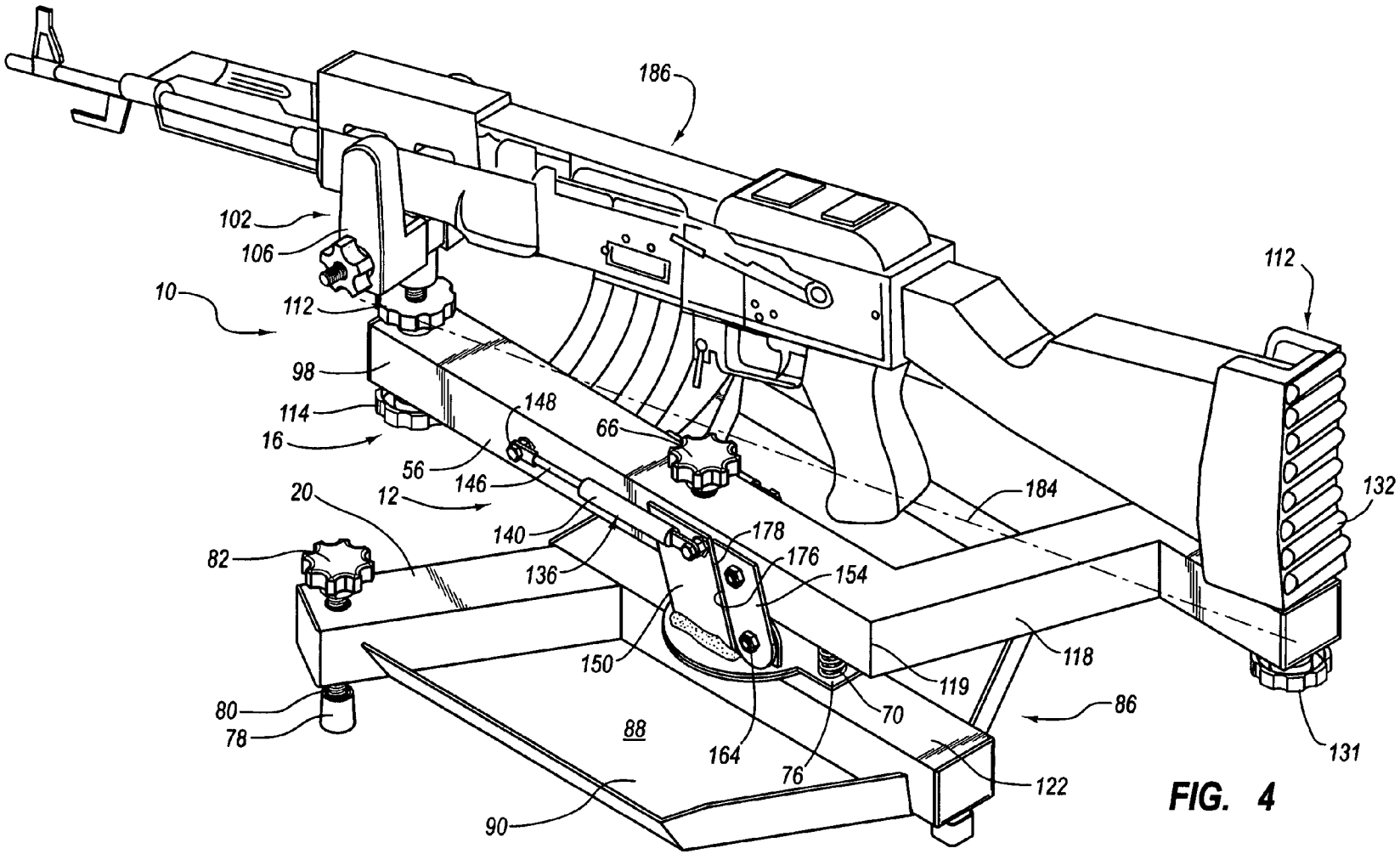
Figure 5:
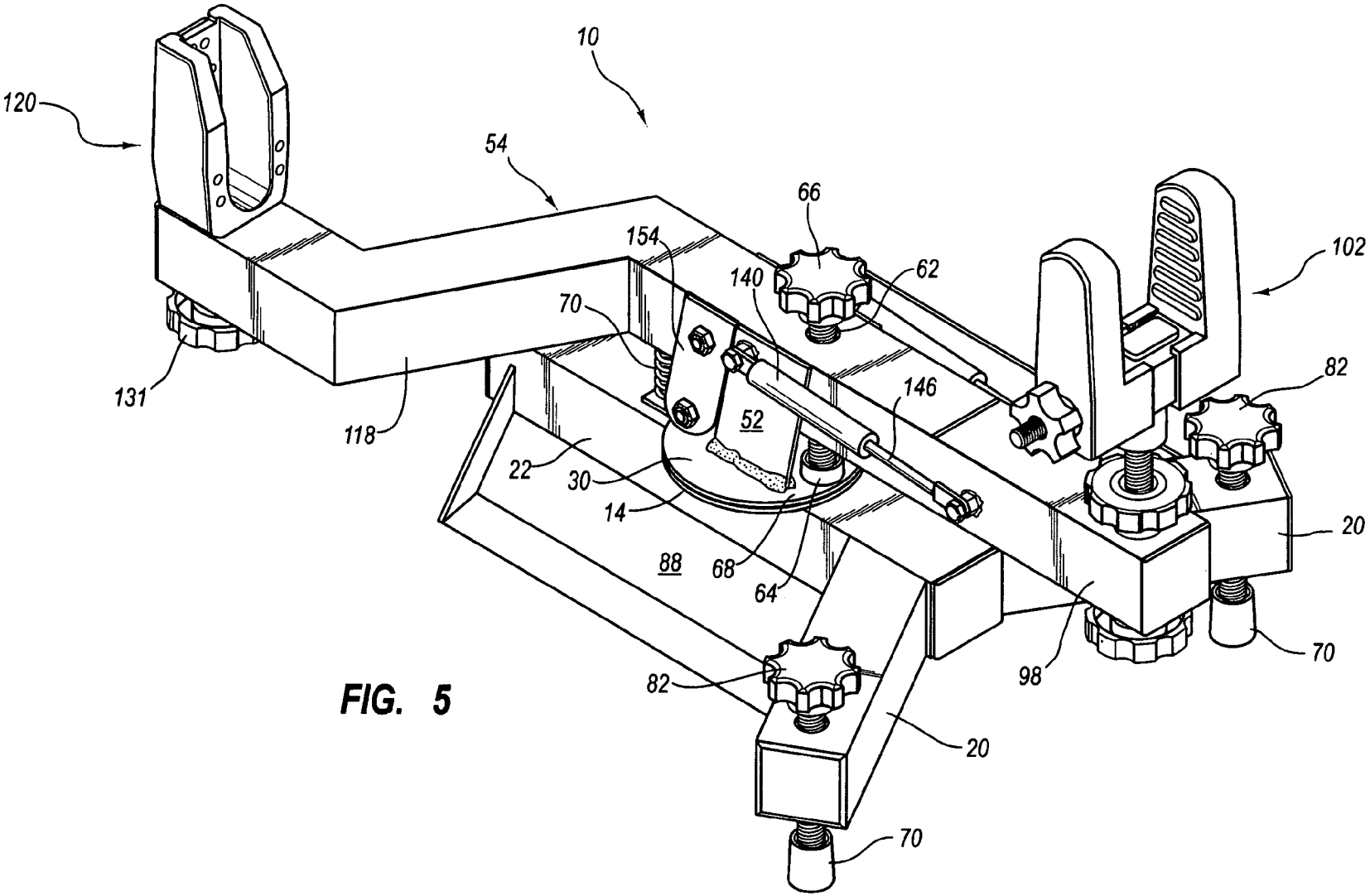
Figure 6:
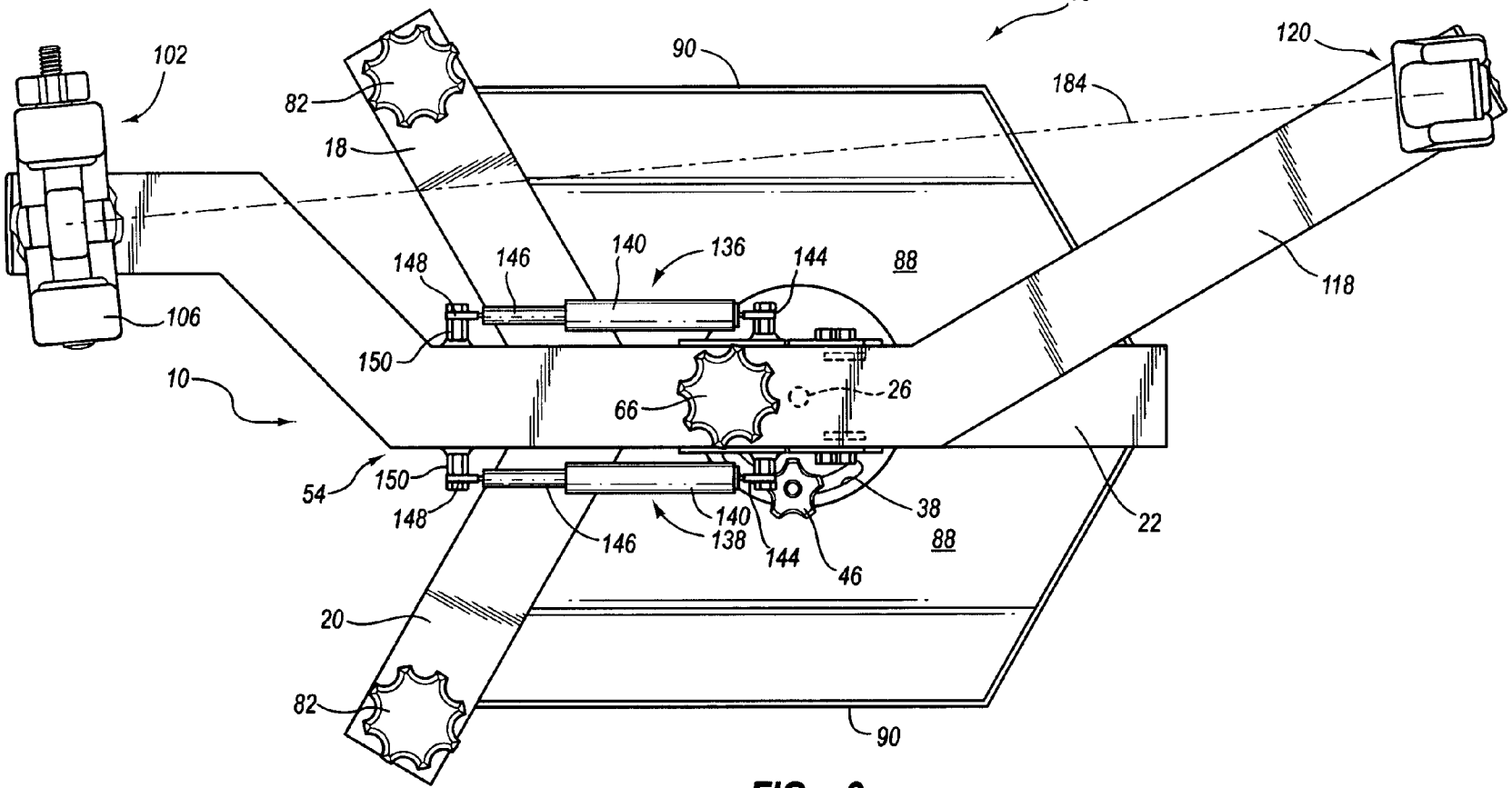
Figure 7:
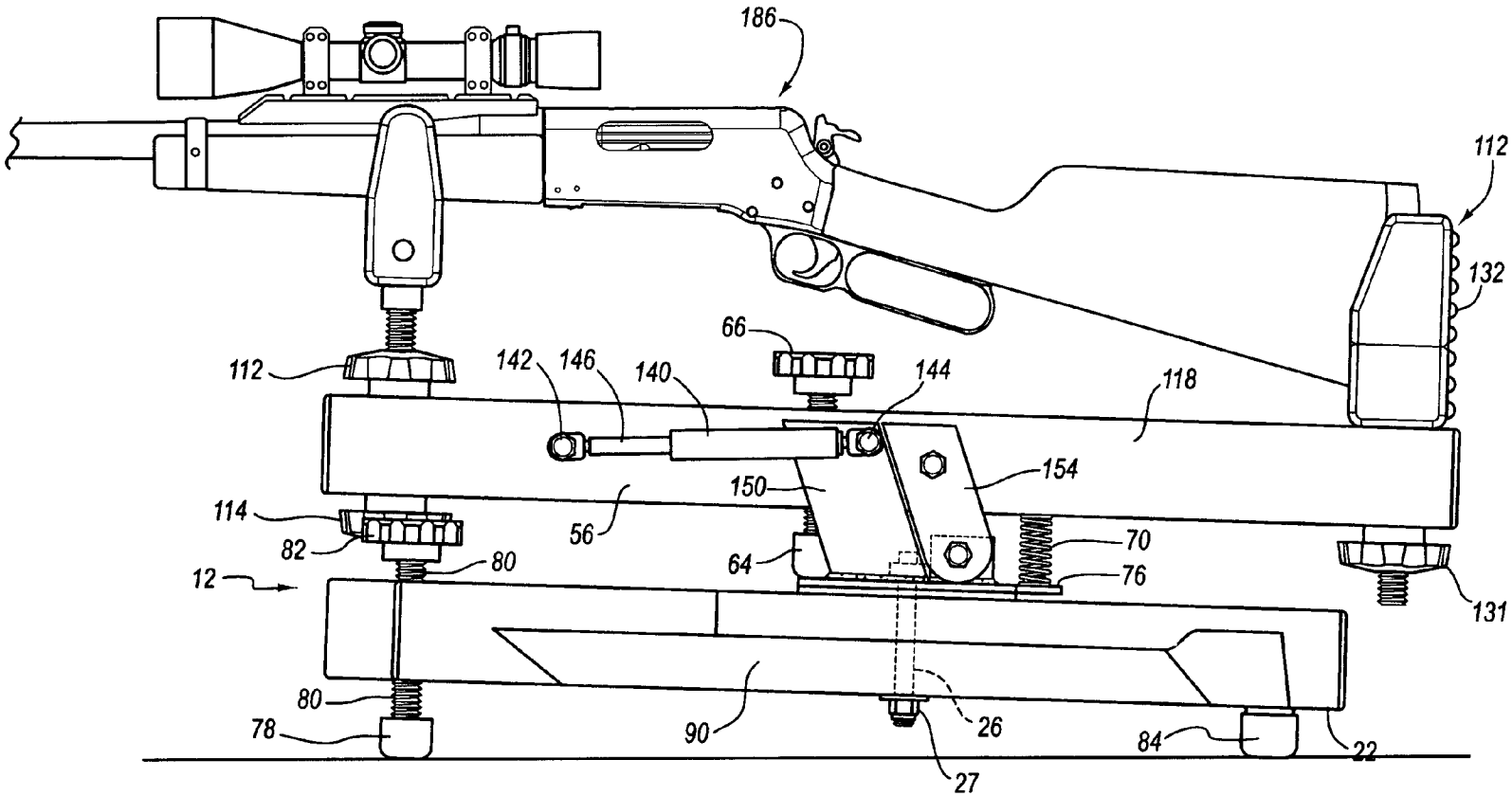
Figure 8:
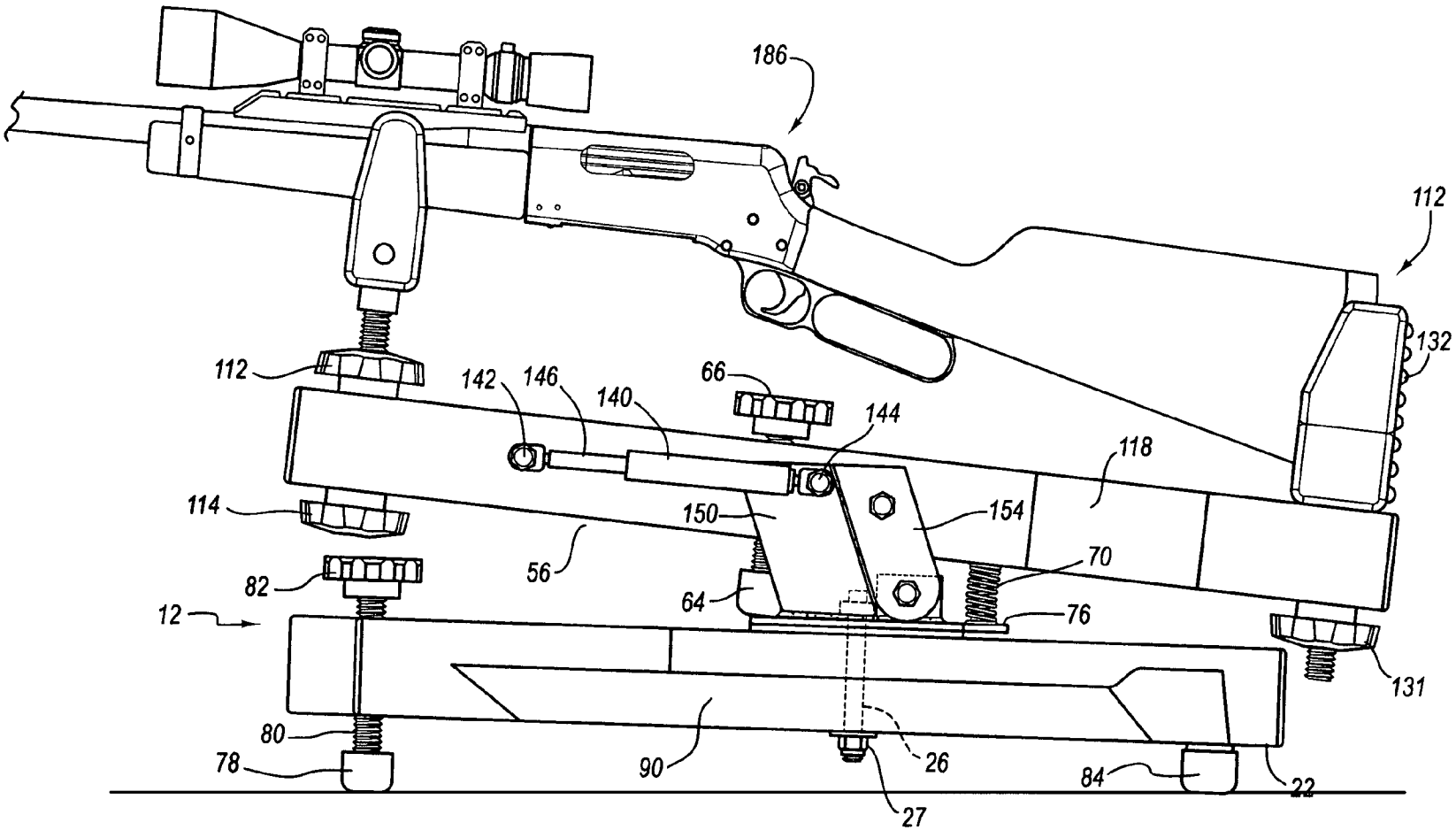

FIG. 4, a perspective view taken from a rear corner of another embodiment of the invention and showing an automatic rifle positioned on the gun holder;

FIG. 5, a perspective view of the gun mount of the invention shown in FIG. 4, but with the automatic rifle removed and with the view being taken from a front corner and slightly above the mount;

FIG. 6, a top plan view of an embodiment of the invention shown in FIGS. 1-3 and including shock absorbers;

FIG. 7, a side elevation view of the embodiment of the invention having a straight support arm positioned over the axis on which the gun holder rotates; and FIG. 8, a side elevation view of the embodiment of the invention shown in FIG. 7, but showing shock absorbers connected between the base and the gun holder to absorb recoil shock of the weapon being fired while using the gun mount.

DETAILED DESCRIPTION

Referring Now to the Drawings

In the illustrated preferred embodiment shown in FIGS. 1-3, the gun mount of the invention is shown generally at 10. Gun mount 10 includes a base 12 having a bottom pivot plate, shown generally at 14 and a gun holder, shown generally at 16. Bottom pivot plate 14 has tripod legs, comprising front legs 18, 20 and a rear leg 22, each fixed to and projecting outwardly and downwardly from the bottom pivot plate 14.

Gun holder 16 is mounted on a pivot shaft formed by a bolt 26 that extends downwardly through the central pivot plate 32 through bottom pivot plate 14 and leg 22. Rotation of the gun holder 16 and a gun positioned thereon will rotate a bottom face 30 of the central pivot plate 32 of the gun holder 16 around pivot shaft 26 and on a top surface 34 of bottom plate 14. A nut 27 on the pivot shaft 26, beneath the top surface of leg 22 holds the pivot shaft 26 in place.

A threaded post 36 is fixed to the top surface 34 of plate 14 of the base 12 and extends upwardly through an arcuate slot 38 formed through the bottom pivot plate 14 of the gun holder. The ends 40 and 42 of the arcuate slot 38 serve as stops to limit rotation of the central pivot plate 32 and the gun holder 16 supported thereon, relative to the bottom pivot plate 14.

A knob 46, threaded onto the upper end of threaded post 36 that projects through the arcuate slot 38, can be turned downwardly on the threaded post 36 to clamp the bottom pivot plate 14 and central pivot plate 32 together. This prevents undesired rotation of the central pivot plate on the bottom pivot plate and horizontally sets a sight picture.

Gun holder 16 includes a pair of spaced apart upstanding plates 50 and 52 fixed to and projecting upwardly from the top surface of central pivot plate 34.

A support arm 54 has a straight central portion 56 that extends between and beyond the upright plates 50 and 52. A bolt pivot 58, having an end cap 60 thereon, is inserted through plate 50, support arm 54 and plate 52. Thus, the support arm will rotate in a vertical plane on the pivot bolt 58.

A vertical adjustment bolt 62 is threaded through the support arm 54 and into a foot member 64 that rests on top of the central pivot plate 32. A knob 66 is fixed to the top of bolt 62 and is used to turn the bolt 62 through support arm 54 and to move the foot member 64 into engagement with a leading edge 68 of central pivot plate 32. A coil spring 70 extends between a pocket 72 formed in the bottom of the support arm 54 and the top surface 34 at a trailing edge 76 of the plate 32.

The front legs 18 and 20 each have an adjustable foot 78 on the end thereof remote from the bottom plate 14. Each foot 78 is on the bottom end of a bolt 80 threaded through the end of the leg and a knob 82 is provided on and is affixed to the top of each bolt 80 so that turning of the knob will thread the bolt through and change the position of the foot relevant to the leg. A foot 84 is provided on the bottom surface of rear leg 22, at the end of leg 22 remote from bottom plate 14.

A weight receiving tray 86 is formed between each of the front legs 18 and 20 and the rear leg 22. The trays each include a flat surface 88 on which sand bags or other weights (not shown) may be placed. A peripheral rim 90 is provided around each tray 86, between a front leg 18 or 20 and the rear leg 22 to better hold the weights in place.

A front portion 98 of the support arm 54 extends beyond the knob 66 and is angled at 100 to extend angularly from one end of the central portion 56 of arm 54. A barrel support 102 is attached to and extends upwardly from the free end of the forward angled portion 98 of arm 54. The barrel support includes a U-shaped receiver 104 having spaced apart wings 106 extending upwardly from a web 108. A threaded post 110 is attached to and extends from beneath web 108 and through a nut 112 and the free end of forward portion 98 of arm 54, and is threaded into a nut 114. The elevation of barrel support 102 is set by adjusting the position of nuts 112 and 114 on post 110.

A rear portion 118 of support arm 54 is also angled at 119 from the central portion 56 of arm 54 to the same side of the central portion 56 as is the forward portion 98. A stock support 120 is mounted on the free end of rear portion 118 of support arm 54. Stock support 120 includes a receiver 122 for the butt of a long gun stock and has spaced apart wings 124 and 126 projecting upwardly from a platform 128. The wings and platform are connected by a rear plate 130. A bolt 129 extends downwardly from platform 128 and through rear portion 118. A nut 131 threaded on bolt 129 secures the receiver 122 to the portion 118 of arm 54. A cushion 132 is positioned on a back, shoulder engaging surface of rear plate 130.

The front portion 90 and rear portion 118 of support arm 54 may extend outwardly to have the free ends an equal distance from the axis through the central portion 56. Thus when a gun is positioned with the gun barrel in the barrel support 102 and the gun stock is positioned in the stock support 120 with the butt of the stock, against the rear plate 130, the gun axis is on the dotted line axis shown at 134. The gun axis is offset from and substantially parallel to the central portion 56 of arm 54. With gun 28 so positioned, and offset from being above the plates 14 and 34 there is ample room for a magazine, or other bottom feed ammunition system extending beneath the gun as it is fired and sighted-in, using the gun mount 10.

Whenever a long gun and particularly a high-powered gun, or a very fast firing automatic gun is fired on a gun mount, the recoil from firing may change a sighting picture both horizontally and vertically. Such recoil naturally tends to change the sighting picture even if the gun holder is positioned directly above a base structure on which the gun holder is positioned. When the gun barrel is positioned to be on a line that is offset from the base structure supporting the gun being fired from a gun mount, the recoil force may also result in a torque force that can also change the horizontal sight picture of a sighted-in gun.

As shown in FIGS. 4-8, a pair of parallel extending shock absorbers 136 and 138 are provided with a shock absorber on each opposite side of and extending parallel to the support arm 54. The shock absorbers serve to minimize the effects of recoil shock. Each shock absorber includes a cylinder 140 having a rear tab 142 through which a shaft 144 is inserted. Each shaft 144 is fixed to and projects from one of the upstanding plates 50 or 52. A rod 146 projecting from each cylinder 140 has a free end 148 pivotally connected at 150 to a shaft 152 that is fixed to and projects from the arm 54.

A pivot link 154 is provided at each side of the arm 54. Each pivot link 154 has one end 156 pivotally mounted on a shaft 158 that extends through the links and the arm 54. Nuts 160 threaded on the ends of shaft 158 hold the shaft in place. Opposite ends 162 of the links 154 are pivotally connected on a shaft 164. Shaft 164 extends through the upstanding plates 166 and 168 that are welded to the central pivot plate 32. Nuts 172 threaded on opposite ends of the shaft hold the shaft in place.

Each pivot link 154 has an impact edge 176 that is slightly spaced away from a rear edge 178 of the adjacent upright plate 50 or 52. A lower end of the impact edge has a curved corner 180 interconnecting the impact edge with a bottom edge of the pivot link 154.

In use of the gun mount 10, the mount is positioned on a table or other suitable stable surface with the legs 18, 20 and 22 resting on the surface.

A gun 186, FIG. 4, to be fired and sighted-in is placed in the gun holder 16 with the barrel supported in the barrel support 102 and the butt of the gun in the receiver 122 of stock support 120.

As previously described and shown in FIGS. 1-3, the support arm has angled front and rear ends 98 and 118, respectively, extended such that gun axis of a gun placed on the gun holder 16 that is pivotally mounted on the base 12 will be parallel to the dotted line axis 184. With the gun so positioned, recoil force is directed along the gun axis to the rear plate 130 of stock support 120. The recoil force, with the gun axis positioned as shown in FIG. 1 and FIG. 2 creates a torque force to pivot the gun in a horizontal axis around the pivot shaft 26.

As the gun is rotated on the gun support 16, around the pivot shaft 26, the projecting lengths of the rods of the shock absorbers 126 and 138 individually change as the shock absorbers absorb the force of arm 54 moving rearward and absorb torque force around the pivot shaft 26.

If the gun axis is over the pivot shaft 26, the shock absorber rods 136 and 138, fixed to the arm 54, will move substantially together to absorb all or part of the recoil shock as the recoil shock acts on the butt plate 130.

Whether the gun holder has an arm 54 with a central arm portion 56 and angled front and rear portions 98 and 118, respectively in straight alignment with an axis 190 overlying the pivot shaft 26, as shown in FIG. 6; or has an arm 54 with front and rear angled portions 98 and 118 to form a gun holder having a gun axis offset from and parallel to the central portion 56 of arm 54 as shown in FIGS. 1-3; or has an arm 54 with one front or rear portion forming a straight connection with central portion 56 and the other front or rear portion angled from the central portion 56 of arm 54, as shown in FIGS. 4-6, the shock absorbers will receive recoil shock transmitted from a gun being fired through the butt of the stock of the rifle and end plate to move the arm 54 rearwardly.

As the arm 54 moves rearwardly it pivots upper ends 154 of links 156 and rotates the lower end 162 of the links 156 about pivot shaft 164. Pivot shaft 164 extends through spaced apart plates 166 that are welded to central pivot plate 32. The lower curved edges 180 of links 156 are then rotated into engagement with upstanding plate 50 and 52 to stop further rearward movement of arm 54. The shock absorbers then return the links 156 and the arm 54 to their start positions, ready to modulate recoil from the next round fired from the gun.

Although a preferred embodiment of our invention has been herein described, it is to be understood that the present disclosure is by way of example and that variations are possible without departing from the subject matter coming within the scope of the following claims, which subject matter we regard as our invention.

We claim:

1. A gun mount for use in firing and sighting-in long guns comprising a base having legs adapted to rest on a support surface and a bottom pivot plate fixed to and above the said legs;

a gun holder including a central pivot plate having a flat bottom face overlying a flat top face of said bottom pivot plate;

a pivot shaft extending through both said pivot plates, whereby said central plate turns about said pivot shaft, on said bottom pivot plate;

a pair of spaced apart upstanding plates facing one another and fixed to an upper face of said central pivot plate;

a support arm having a straight central portion extending between said pair of spaced apart upstanding plates, a front portion having a gun barrel support thereon extending upwardly said front portion and a rear portion having a gun stock support thereon extending upwardly from said rear portion;

a pivot bolt extending through said upstanding plates and said central portion of said support arm whereby said support arm will pivot in a vertical plane between said upstanding plates;

a spring between said support arm and a top rear surface of said central plate to bias said support arm above central plate; and a vertical adjustment bolt threaded through said support arm, said vertical adjustment bolt having a knob fixed to the top thereof and a foot on the bottom thereof, said foot engaging a top front surface of said central plate whereby turning of said knob pivots said front portion of said support arm up or down in a vertical plane.

2. A gun mount as in claim 1, further including means to releasably clamp the central plate to the bottom plate.

3. A gun mount as in claim 1, further including shock absorber means interconnecting the support arm and the spaced apart upright plates.

4. A gun mount as in claim 3, wherein the shock absorber means includes a pair of shock absorbers each having a cylinder and a rod projecting from said cylinder;

means pivotally connecting one end of one of said cylinders to one of the spaced apart upstanding plates at one side of the support arm;

means pivotally connecting the end of said rod projecting from said cylinder to the support arm;

means pivotally connecting one end of the other cylinder to the other of said spaced apart upstanding plates at an opposite side of the support arm; and means connecting the end of said rod projecting from said other one of said cylinders to an opposite side of the support arm, with both cylinders and both projecting rods extending substantially parallel to said central portion of said support arm.

5. A gun mount as in claim 1, wherein the front and rear end portion of the support arm form straight extensions aligned with the central portion of the support arm.

6. A gun mount as in claim 1, wherein at least one of the front and rear portions of the support arm is angled to extend to one side of the center portion of the support arm.

7. A gun mount as in claim 5, wherein both the front and rear portions of the support arm are angled to extend to one side of the center portion of the support arm.

8. A gun mount as in claim 5, wherein the shock absorber means includes a pair of shock absorbers each having a cylinder and a rod projecting from said cylinder;

means pivotally connecting one end of one of said cylinders to one of the spaced apart upstanding plates at one side of the support arm;

means pivotally connecting the end of said rod projecting from said cylinder to the support arm;

means pivotally connecting one end of the other cylinder to the other end of said spaced apart upstanding plates to an opposite side of the support arm; and means connecting the end of said rod projecting from said other one of said cylinders to an opposite side of the support arm with both cylinders and both projecting rods extending substantially parallel to said central portion of said support arm.

9. A gun mount as in claim 6, further including shock absorbing means interconnecting the support arms and the spaced apart upright plates.

10. A gun mount as in claim 9, wherein the shock absorber means includes a pair of shock absorbers each having a cylinder and a rod projecting from said cylinder;

means pivotally connecting one end of one of said cylinders to one of the spaced apart upstanding plates at one side of the support arm;

means pivotally connecting the end of said rod projecting from said cylinder to the support arm;

means pivotally connecting one end of the other cylinder to the other end of said spaced apart upstanding plates to an opposite side of the support arm; and means connecting the end of said rod projecting from said other one of said cylinders to an opposite side of the support arm with both cylinders and both projecting rods extending substantially parallel to said central portion of said support arm.

11. A gun mount as in claim 7, further including shock absorbing means interconnecting the support arms and the spaced apart upright plates.

12. A gun mount as in claim 11, wherein the shock absorber means includes a pair of shock absorbers each having a cylinder and a rod projecting from said cylinder;

means pivotally connecting one end of one of said cylinders to one of the spaced apart upstanding plates at one side of the support arm;

means pivotally connecting the end of said rod projecting from said cylinder to the support arm;

means pivotally connecting one end of the other cylinder to the other end of said spaced apart upstanding plates to an opposite side of the support arm; and means connecting the end of said rod projecting from said other one of said cylinders to an opposite side of the support arm with both cylinders and both projecting rods extending substantially parallel to said central portion of said support arm.

13. A gun mount as in claim 12, wherein the legs form a tripod with a pair of front legs and a rear leg, and further including trays interconnecting each of said front legs and said rear leg to receive weights thereon.

* * * * *